US005144999A

United States Patent [19]

Makino et al.

[11] Patent Number: 5,144,999

[45] Date of Patent: Sep. 8, 1992

[54] APPARATUS FOR MAKING AMORPHOUS METAL STRIPS

[75] Inventors: Akihiro Makino; Tomio Takase, both of Nagaoka, Japan

[73] Assignee: Alps Electric Co., Ltd., Tokyo, Japan

[21] Appl. No.: 855,131

[22] Filed: Mar. 18, 1992

Related U.S. Application Data

[63] Continuation of Ser. No. 558,716, Jul. 27, 1990, abandoned.

[30] Foreign Application Priority Data

Aug. 31, 1989 [JP] Japan ..... 1-225557
Mar. 26, 1990 [JP] Japan ..... 2-75948
Mar. 26, 1990 [JP] Japan ..... 2-75949

[51] Int. Cl.[5] ..... B22D 11/06
[52] U.S. Cl. ..... 164/423; 164/429
[58] Field of Search ..... 164/463, 423, 429, 479

[56] References Cited

U.S. PATENT DOCUMENTS 3,345,738 10/1967 Mizikar et al. ..... 29/527.7
4,142,571 3/1979 Narasimhan .

FOREIGN PATENT DOCUMENTS 57-195564 12/1982 Japan ..... 164/463
58-20357 2/1983 Japan ..... 164/463
WO84/03852 10/1984 PCT Int'l Appl. ..... 164/423
847643 9/1960 United Kingdom ..... 164/429

*Primary Examiner*—Kuang Y. Lin
*Attorney, Agent, or Firm*—Guy W. Shoup; David W. Heid; B. Noel Kivlin

[57] ABSTRACT

An apparatus for continuously making an amorphous metal strip used, for example, as a blank for a voice magnetic head, deposits molten metal from a nozzle onto the surface of a cooling roll under a fixed pressure and while the cooling roll rotates, the molten metal is rapidly cooled and solidified on the cooling roll. A rotation speed control adjusts the rotation of the cooling roll so that the speed is gradually reduced during the manufacturing process. The nozzle may be provided at an angle to the surface to the cooling roll with the nozzle opening opposing the direction of rotation. Alternatively, the nozzle may be provided perpendicular to the surface and off the center access of the cooling roll opposite the rotating direction of the cooling roll. In this embodiment, the tip of the nozzle is shaped with an angled opening. Moreover, the surface of the cooling roll may have a roughness greater than a mirror-smooth surface.

2 Claims, 9 Drawing Sheets

APPARATUS FOR MAKING AMORPHOUS METAL STRIPS

This application is a continuation of application Ser. No. 07/558,716, filed Jul. 27, 1990, now abandoned.

BACKGROUND OF THE INVENTION

1. Field of the Invention

The present invention relates to an apparatus for continuously making amorphous metal strips used, for example, as a blank for a voice magnetic head.

2. Prior Art

As an apparatus for continuously making amorphous metal strips (or ribbons). there has been known an apparatus according to a so-called single roll method shown in FIG. 13. In this apparatus, a cooling roll 1 made of is rotated at a high speed, and molten metal 3 is blown from a nozzle 2 arranged in close proximity of a top of the cooling roll, and the molten metal 3 is drawn in a rotational direction of the cooling roll 1 while the molten metal is rapidly cooled and solidified on the surface of the roll 1. In this case, the cooling roll 1 has its surface mirror-finished. The nozzle 2 is provided to be approximately vertical with respect to the top cf the cooling roll 1, and a clearance between the tip thereof and the surface cf the cooling roll 1 is set to 1 mm or less. The molten metal 3 discharged out of the nozzle 2 forms a reservoir (puddle) 4 which is substantially stationary between the tip of the nozzle 2 and the surface of the cooling roll 1. As the cooling roll 1 rotates, the molten metal 3 is drawn in the form of a strip from the reservoir 4 and cooled and solidified on the surface of the cooling roll 1 whereby a strip 5 is continuously formed.

However, the prior art as described above has a construction using a cooling roll, and therefore, a temperature of the roll increases as manufacturing progresses. A clearance between the roll and the nozzle is reduced due to the thermal expansion of the roll to gradually reduce a thickness of the strip. Thereby, the thickness of the strip becomes uneven, or the nozzle tip is dipped into the reservoir to produce a turbulence of flow of the molten metal and unevenness of thickness.

As means for solving such inconveniences as noted above, a method for varying a position of a nozzle to control a gap amount has been proposed (see Japanese Patent Publication No. 60-43221).

However, in the manufacturing apparatus as described above, the nozzle incidental to a vessel for molten metal is moved up and down. Therefore, a large-scaled driving is required, resulting in a large space for the apparatus and an increase in cost. In addition, locating with accuracy cannot be easily accomplished, and as a result, the cost of apparatus further increases, which problems should be solved.

Furthermore, the amorphous metal strip used as a blank of a voice magnetic head is required that the surface thereof is sufficiently flat, that is, the roughness of the surface is sufficiently small. However, the surface roughness of the strip produced by the aforementioned conventional device is not always so small as to be usable for the voice magnetic head. Moreover, the surface roughness of both surfaces greatly becomes uneven, that is, there poses a disadvantage that the surface roughness of a free solidified surface formed by being solidified without contacting the roll becomes large as compared with the roll contact surface formed being solidified while contacting the roll. Therefore, this is hard to be used as a blank for a voice magnetic head.

SUMMARY OF THE INVENTION

The present invention has been achieved in view of the foregoing. It is an object of the present invention to provide an apparatus for manufacturing amorphous metal strips which can make a thickness of an amorphous metal strip even, reduces a roughness of surface, and reduce unevenness of the surface roughness in both surfaces of the strip.

For solving the aforementioned problems, there is provided in a first embodiment an apparatus for making amorphous metal strips in which molten metal is poured from a nozzle onto a surface of a cooling roll, and the molten metal is rapidly solidified on the cooling roll to thereby make an amorphous metal strip, the rotation of the cooling roll being gradually reduced according to the passage of the producing time. In a second embodiment, there is provided an apparatus for making amorphous alloy strips in which molten metal is blown from a nozzle whose tip is arranged in close proximity of the surface of a cooling roll on the surface of the cooling roll which rotates at a high speed, and the molten metal is formed into a strip while cooling the molten metal on the surface of the cooling roll and then drawn in a rotational direction of the cooling roll, characterized in that said nozzle is arranged in close proximity of the top of said cooling roll in a state where the tip of the cooling nozzle is inclined with respect to a vertical plane so that the tip is directed rearward of the rotational direction of the cooling roll.

In a third embodiment, there is provided an apparatus similar to the former, characterized in that said nozzle is arranged closely to be vertical with respect to a position rearward of rotational direction from the tip of said cooling roll whereby said tip is inclined with respect to the surface of the cooling roll.

Furthermore, in a fourth embodiment, forth in claim 8, there is provided an apparatus similar to the former, characterized in that the surface of the cooling roll is finished to a roughness corresponding to the roughness obtained by polishing by use of a polishing paper having abrasive grain number #600 to #1,000.

In the apparatus for making amorphous metal strips according to the first embodiment, the roll expands with the passage of the manufacturing time, and the clearance between the tip of the nozzle and the cooling roll reduces and a quantity of reservoir formed thereat is also reduced. As the rotational speed of the roll slows down, a degree to be transported incidental to the cooling roll increases. As a consequence, the thickness of solidification is controlled to be constant.

In both the apparatuses according to the second and third embodiments, the tip of the nozzle is inclined with respect to the surface of the cooling roll so as to be directed rearward in the rotational direction thereof. Therefore, the reservoir (puddle) formed between the tip cf the nozzle and the surface of the poling roll is larger than the case where the nozzle is straight.

The molten metal is drawn out of the reservoir by rotation of the cooling roll to form a strip. At that time, the volume of the reservoir is varied minutely. The larger the volume of the reservoir, the substantial variation of volume is small. Accordingly, the molten metal is drawn stably as compared with the case where the reservoir is small. Thereby, the roughness of the surface of the strip formed is improved.

Moreover, in the apparatus according to the present invention as set forth in the fourth embodiment, a strip prepared by the conventional apparatus in which the surface of the cooling roll is mirror-surface finished is observed. Longitudinally wavy rugged portions are formed in the free solidified surface, and the roughness of the surface becomes large due to the rugged portion. It is considered that the rugged portion resulted from an occurrence of a minute slip on the roll as the strip is drawn out of the reservoir. On the other hand, some rugged portion appearing in the free solidified surface is observed in the roll contact surface to be solidified while contacting the roll. However, basically, since the rugged portion of the roll surface is transferred without modification, the surface roughness is smaller than the free solidified surface.

In view of the foregoing, as set forth in the fourth embodiment, the surface of the cooling roll is finished to be rougher than the mirror surface whereby friction between the strip and the roll surface is increased to thereby prevent a slip of the strip relative to the roll to prevent an occurrence of the rugged portion in the free solidified surface, thus improving the surface roughness of the free solidified surface. Since the surface roughness of the roll contact surface relies upon the roughness of the roll surface, the roughness of the roll surface is optimally set whereby roughnesses of both the surfaces can be made even.

BRIEF DESCRIPTION OF THE DRAWINGS

and FIG. 8 a view showing the relationship between the spacing between the nozzle and the cooling roll and the surface roughness.

FIG. 10 an enlarged view of a nozzle tip portion, and FIG. 11 a view showing the relationship between an angle of inclination of a nozzle and surface roughness.

DETAILED DESCRIPTION OF THE PREFERRED EMBODIMENTS

Figure 2:
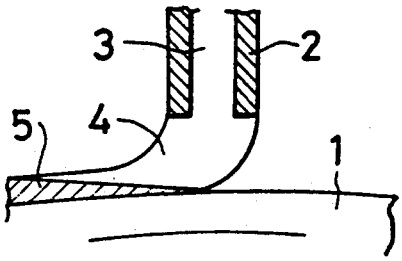
Figure 3:
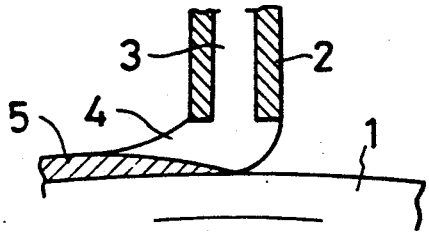

First, a first embodiment will be described with reference to FIGS. 1 to 3.

Figure 1:
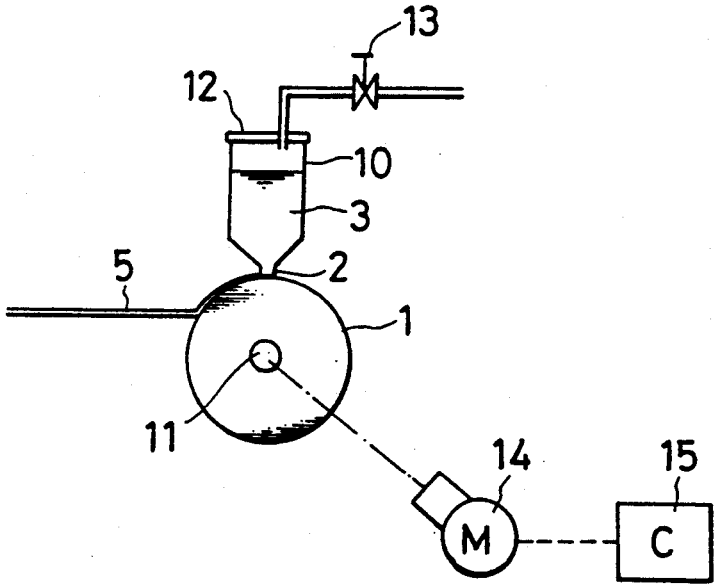
FIGS. 1 to 4 show a first embodiment of apparatus according to the present invention, FIG. 1 being a schematic structure of apparatus, FIG. 2 a view schematically showing the status in the vicinity of a nozzle at the first term of manufacture, FIG. 3 a view schematically show the status in the vicinity cf a nozzle at the latter term of manufacture, and FIG. 4 a graph showing the effect of the process according to the present invention in comparison with the conventional process.

FIG. 1 schematically shows a manufacturing apparatus according to a first embodiment. The apparatus is composed of a vessel 10 for storing molten metal 3 and a cooling roll 1 with a rotational shaft 11 horizontally arranged underside of the vessel. The vessel 10 is internally lined with a heat resistant material, and is provided, when necessary, with a heater for keeping the molten metal 3 warm or for melting material. The vessel 10 is provided at its lower portion with a nozzle 2 which extends in an axial direction of the cooling roll 1 and opens in the form of a slit, said nozzle being positioned facing to the upper surface of the cooling roll 1, said nozzle 2 having its width set so that a suitable quantity of molten metal 3 may flow out in dependency of viscosity of the molten metal 3. The vessel 10 is further provided at its top with a lid 12 by which the vessel is sealed. said upper space being communicated with a source of pressurized air not shown through a valve 13 so that the upper surface of the molten metal 3 is pressurized to permit the molten metal 3 flow out of the nozzle 2.

The cooling roll 1 is formed of a metal material which is high in heat conductivity and high in hardness such as copper alloy, the cooling roll 1 being interiorly formed with a cooling jacket (not shown) so that the roll may be cooled by coolant such as water. Mounted on the roll 1 is a drive motor 14 provided with a reduction gear, and a controller 15 is provided to control the rotational speed thereof. This controller 15 is programmed so that the rotational speed is gradually reduced according to the time of lapse after start of manufacture in advance. A controller of the type to be controlled in accordance with said program is employed.

A process for making an amorphous metal strip by the manufacturing apparatus constructed as described above will be described hereinafter.

First, metal having a composition as required is molten and then stored in the vessel 10. The valve 13 communicated with the source of gas is closed to prevent the molten metal from flowing out. The cooling roll 1 is rotated at a predetermined fixed speed, and the valve 13 communicated with the source of gas is opened to let the molten metal 3 flow out of the nozzle 2. Then, a reservoir 4 (see FIGS. 2 and 3) is formed between the surface of the cooling roll 1 and the nozzle 2. In a portion of the reservoir 4 in contact with the surface of the cooling roll 1, solidification caused by cooling by way of the cooling roll 1 progresses, and the solidified strip 5 is transported with the rotation of the cooling roll 1. The strip 5 is rotated at a suitable angle, at which position the strip 5 is separated from the cooling roll 1 and wound on a take-up roll not shown.

The rotational speed of the cooling roll 1 is controlled a controller so that the roll 1 rotates at the highest speed at first and then gradually slows down as time passes after commencement of manufacture. At that time, the state of the reservoir 4 is that at the initial stage, since the clearance between the surface of the cooling roll 1 and the tip of the nozzle 2 is relatively large as shown in FIG. 2, the quantity of the reservoir 4 is also large but the rotational speed is high. Therefore, the quantity transported by the cooling roll 1 is also large, and the quantity of the molten metal 3 per area of the cooling roll 1, that is, the thickness of solidification is limited to have a fixed thickness. On the other hand, when time after commencement of manufacture has passed, the cooling roll 1 expanded to reduce the clearance to reduce the quantity of the reservoir 4, whereby the quantity of outflow is limited. However, since the rotational speed lowers, a fixed thickness is maintained after all.

EXPERIMENTAL EXAMPLE

Figure 4:
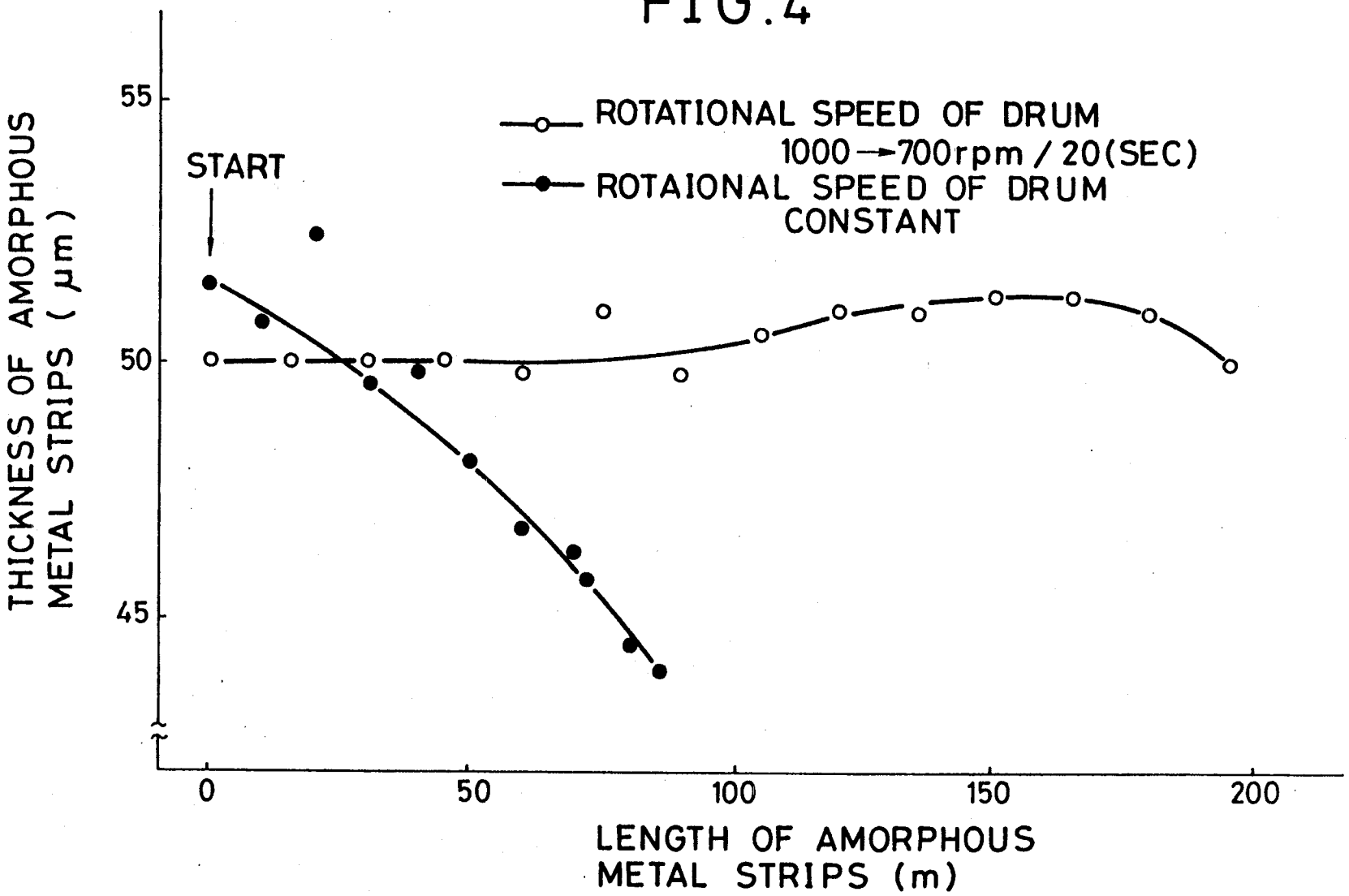
Figure 5:
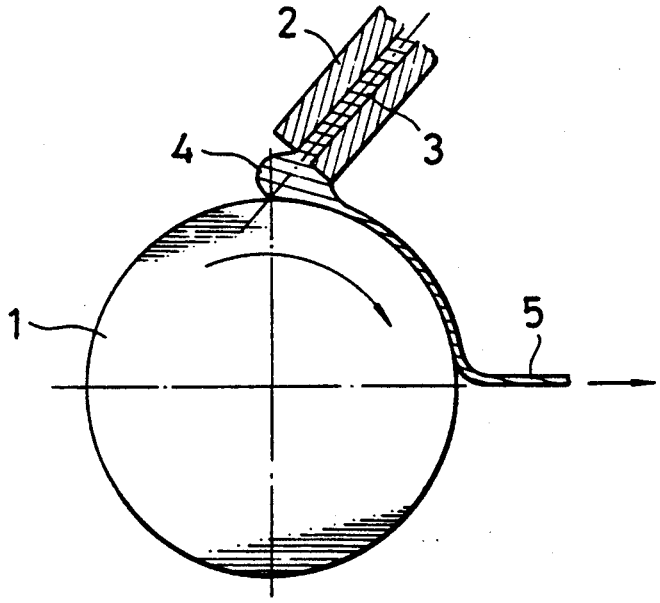
FIGS. 5 to 8 show a second embodiment of apparatus according to the present invention, FIG. 5 being a schematic structural view, FIG. 6 an enlarged view of a nozzle tip portion FIG. 7 a view showing the relationship between an angle of inclinination of a nozzle and surface roughness.
Figure 6:
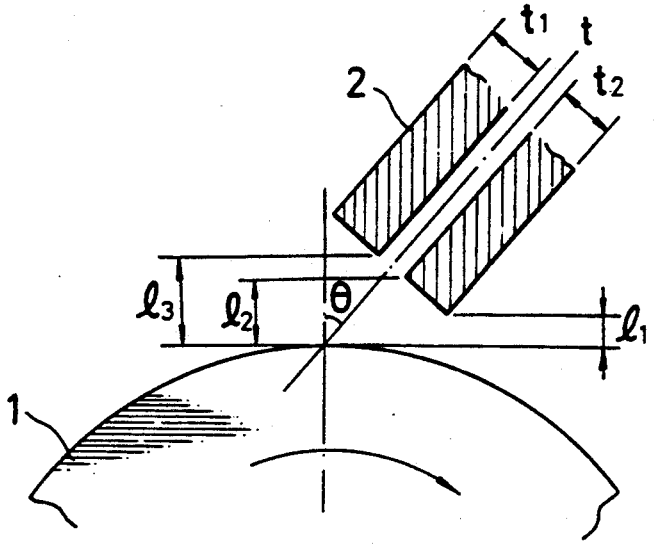

The result obtained by measuring a length of strips manufactured in a direction of lengthwise in a case where the cooling roll 1 is reduced in speed linearly from 1,000 rpm to 700 rpm and in a case where the cooling roll 1 is not at all reduced in speed in with the manufacturing apparatus of the first embodiment is shown in FIG. 4. Metal used as a blank was an alloy of a cobalt group. Time required for manufacture was 10 to 20 seconds. Pressure applied into the vessel 1 from the source of gas was 0.4 kg/cm$^2$.

As shown in the result, in the case where the rotational speed is reduce, an approximately uniform thickness maintained to the last whereas in the case where the rotational speed is not reduced, the thickness is linearly decreased, and a large partial unevenness of thickness occurs.

A degree of expansion of the cooling roll is normally constant. The speed is linearly lowered in accordance with a predetermined program to thereby control a sufficiently practical thickness.

Next, the second embodiment will be described with reference to FIGS. 5 to 8.

Figure 13:
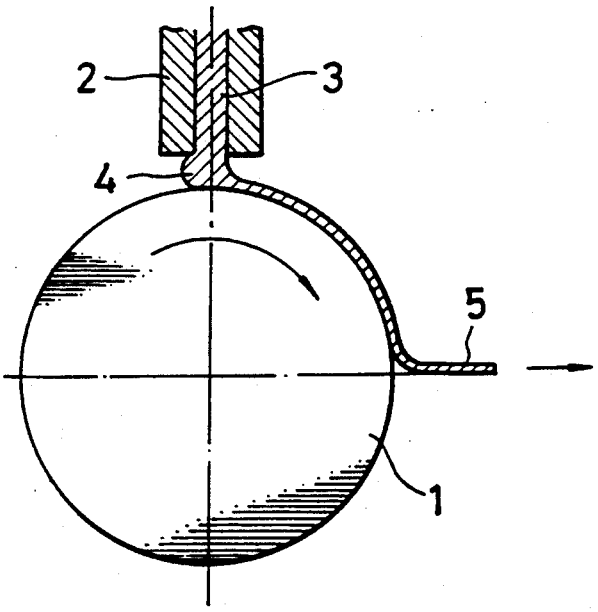
FIG.13 (PRIOR ART)
FIG. 13 is a schematic structural view of a conventional apparatus.

In the second embodiment, similarly to prior art shown in FIG. 13, the molten metal 3 is blown against the surface of the cooling roll 1 which rotates at a high speed from the nozzle 2. The tip of nozzle 2 is arranged closely so as to face the surface of the cooling roll 1, whereby the molten metal 3 is drawn in the rotational direction of the cooling roll 1 while cooling it on the surface of the cooling roll 1. The nozzle 2 is arranged in close proximity of the top of the cooling roll 1, the nozzle being provided so that the tip thereof is inclined with respect to the vertical plane to be directed rearward (leftward in the figure) in the rotational direction. The angle of inclination $\theta$ cf the nozzle 2 to the vertical plane is set to the range not in excess of 40° for the reason described later.

Dimensions of various portions of the nozzle 2 and the clearance between it and the cooling roll 1 may suitably set. Preferably, the slit dimension t the nozzle 2 shown in FIG. 6 was set to 0.5 mm, dimension of wall-thickness $t_2$ 1.00 mm, and the distance $l_1$ between the tangential line passing through the apex of the cooling roll 1 and the lowest end of the nozzle 2 approximately 0.5 mm. A clearance between the lower portion of the slit and the aforesaid tangential line is $l_2=l_1+t_2 \sin \theta$. A clearance between the upper portion of the slit and the aforesaid tangential line is $l_3=l_1+(t_1+t_2)\sin \theta$. Thus, in case of $t_1=0.5$ mm, $t_2=1.0$ mm, $l_1$0.5 mm and $\theta=40°$, $l_2 \approx 1.14$ mm and $l_3 \approx 1.46$ mm.

Figure 7:
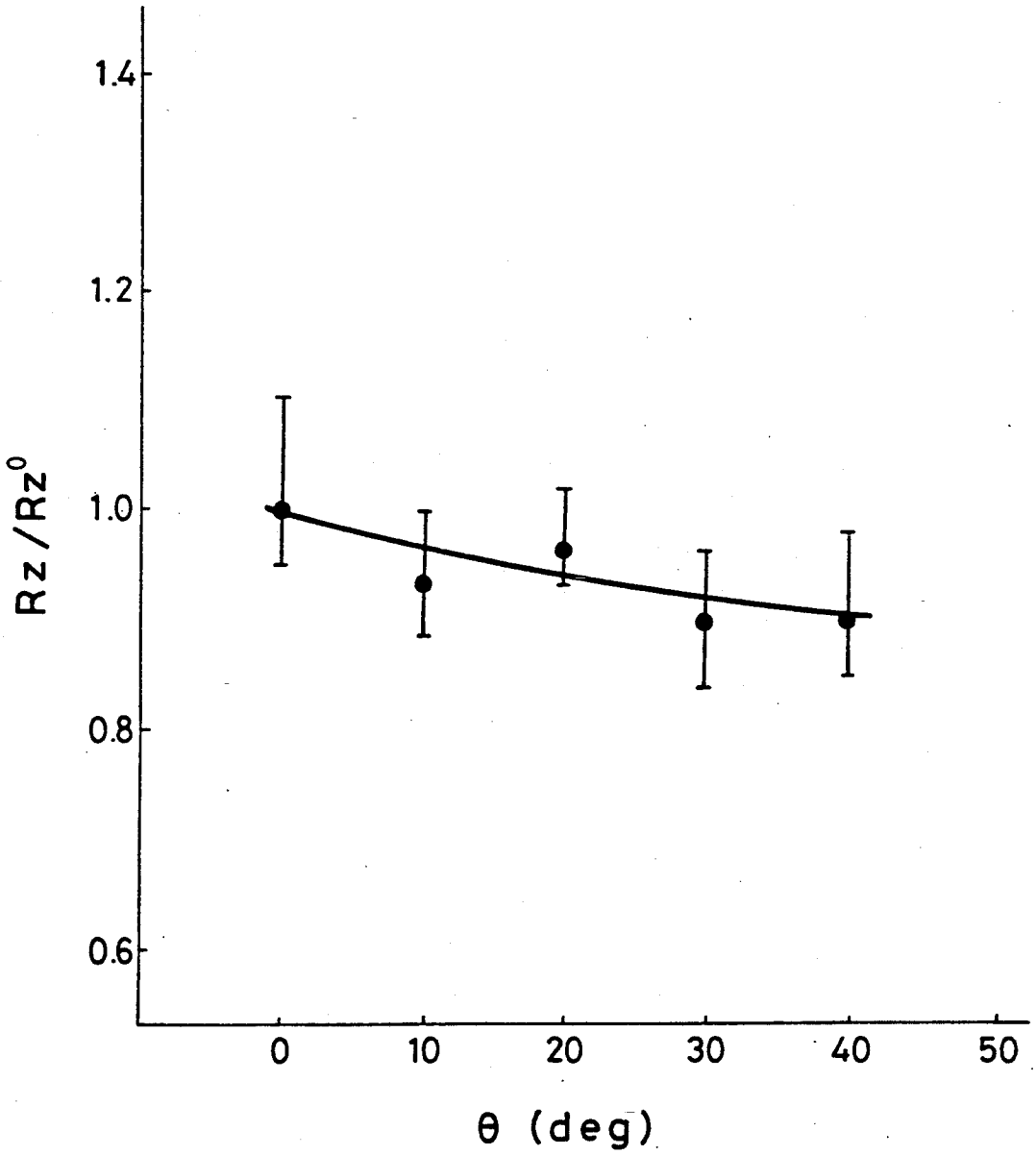

In the apparatus in which the nozzle 2 is inclined with respect to the vertical plane whereby the tip thereof is arranged obliquely with respect to the surface of the cooling roll 1, as described above, the surface roughness of the strip 5 is improved over the case where the nozzle 2 is not inclined, as will be apparent from the measured result shown in FIG. 7.

FIG. 7 shows actually measured data representative of the relationship between the angle inclination $\theta$ of the nozzle 2 and the surface roughness Rz, in which the axis of abscissa represents the angle of inclination $\theta$ of the nozzle 2, and the axis of ordinate represents the ratio $Rz/Rz^0$ between the surface roughness $Rz^0$ in case where the angle of inclination is 0° and the surface roughness Rz in case where the nozzle 2 is inclined. It is understood from this figure that the larger the angle of inclination $\theta$, the smaller the surface roughness Rz is small, that is, the surface is flatter. Measured values of the surface roughnesses $Rz^0$ and Rz are obtained by measuring a 10-point average roughness as set forth in JIS (Japanese Industrial Standards) B 0601 using a cat whisker type surface-roughness meter.

The nozzle 2 is inclined to thereby reduce the surface roughness z because the reservoir (puddle) 4 formed between the tip of the nozzle 2 and the cooling roll 1 is larger than the case where the nozzle 2 is not inclined, and accordingly, the molten metal 3 is drawn out of the reservoir 4 to substantially reduce a fine variation of volume of the reservoir 4 so tat the molten metal 3 is stably drawn.

In the case where the clearance $l_1$ between the lowermost end of the nozzle 2 and the cooing roll 1 is constant, the larger the angle of inclination $\theta$, the reservoir 4 is large. When the angle of inclination exceeds 40°, the molten metal 3 flows down rearward in the rotational direction of the cooling roll 1 due to its own weight and the reservoir 4 is not formed. Accordingly, it is necessary to set the angle of inclination in the range not in excess of 40°.

In the case where the nozzle 2 is inclined so that the tip thereof is directed forwardly in the rotational direction of the cooling roll 1, a large reservoir 4 is not formed, and accordingly, in that case, the effect of improving the surface roughness be obtained.

Figure 8:
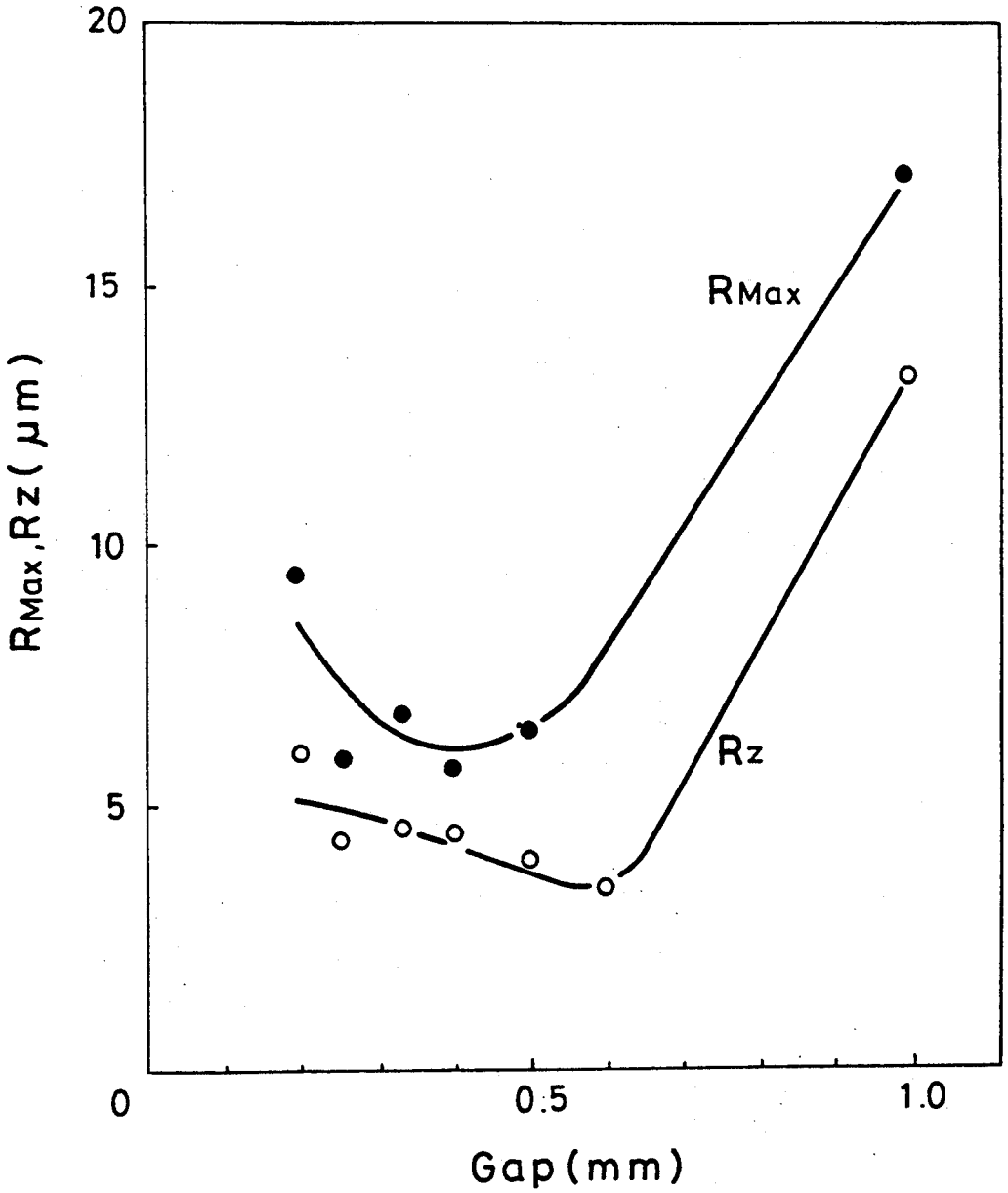

FIG. 8 shows the result of investigation of the influence of the clearance between the tip of the nozzle 2 and the surface of the cooling roll 1 to the surface roughness in the case where the angle inclination $\theta$ of the nozzle 2 is constant. In FIG. 8, the axis of abscissa represents the clearance (the $l_1$) between the tip of the nozzle 2 and the surface of the cooling roll 1, and the axis of ordinate represents the surface roughnesses Rz and Rmax of the strip 5 formed. Rmax represents the maximum surface roughness measured by the cat whisker type surface-roughness meter. It is understood from this figure that if the $l_1$ is set within the range of 0.3 to 0.5 mm,. the surface roughnesses Rz and Rmax are minimum, and therefore, preferably, the value of the $l_1$ is set within the range of said value. In the case where the nozzle 2 is used, and $\theta=40°$, $l_2 \approx 0.94$–1.14 mm and $l_3 \approx 1.26$–1.46 result, and therefore, the clearance between the slit of the nozzle 2 and the cooling roll 1 is substantially larger than the conventional case where it is normally smaller than 1 mm.

Figure 9:
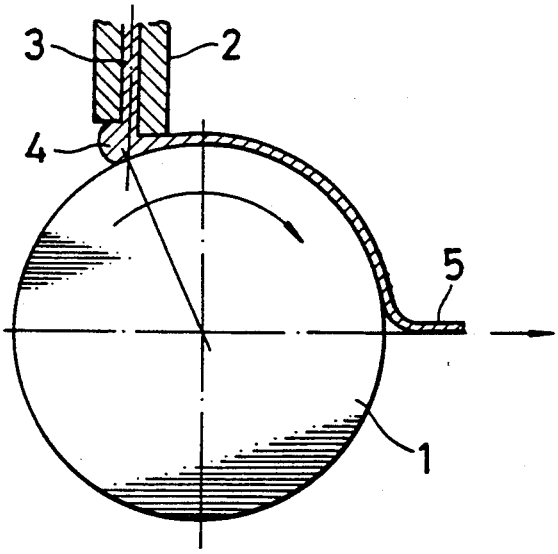
FIGS. 9 to 11 show a third embodiment of apparatus according to the present invention, FIG. 9 being a schematic structural view.
Figure 10:
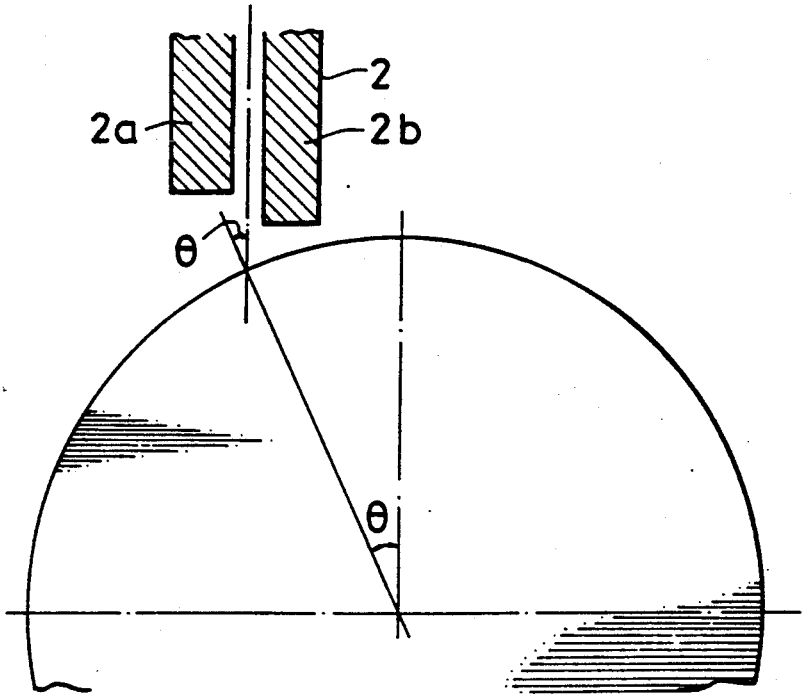
Figure 11:
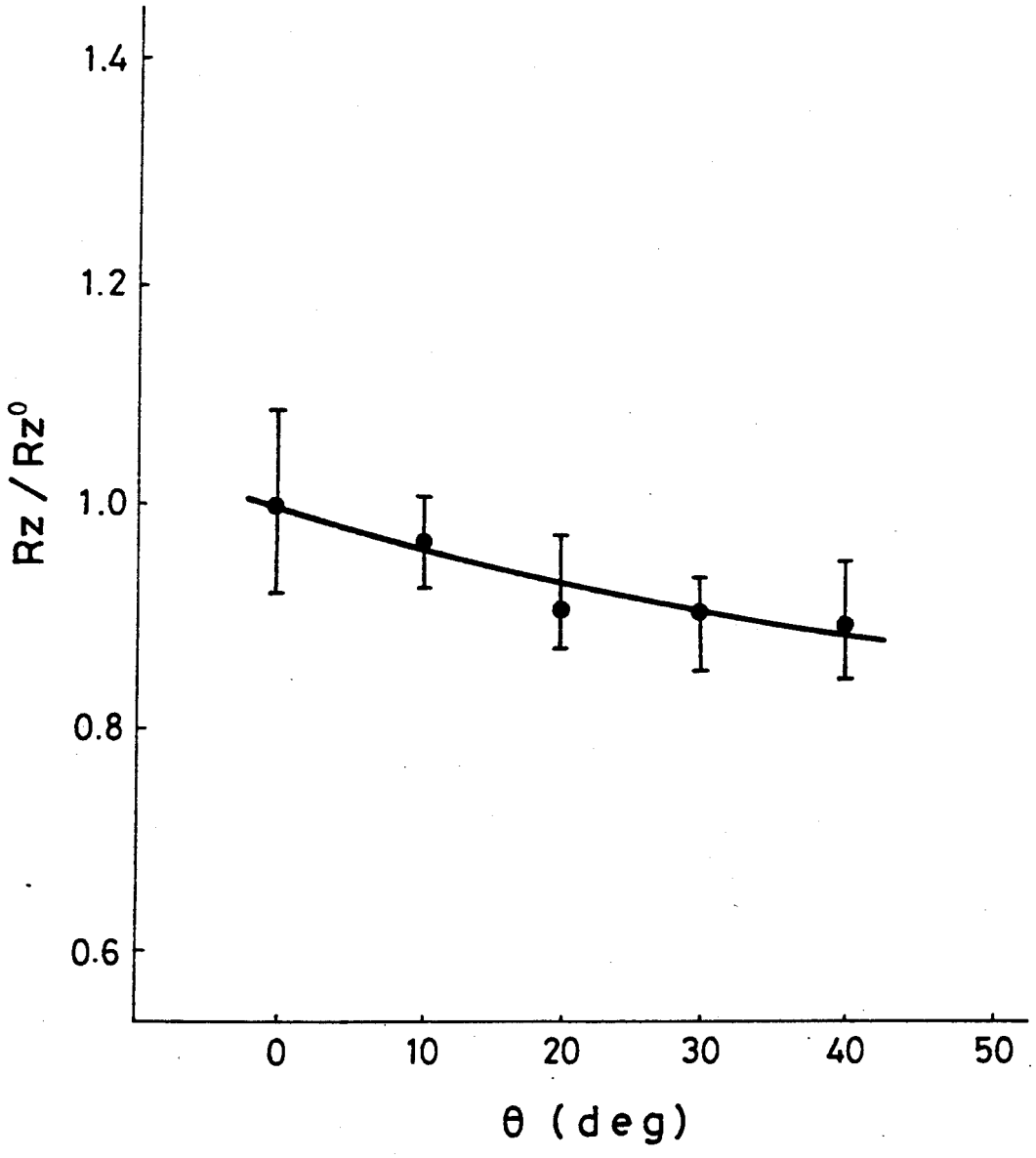

The, third embodiment will be descried hereinafter with reference to FIGS. 9 to 11.

In the apparatus of the third embodiment, the cooling roll 1 is rotated in the same direction as that of the prior art shown in FIG. 13, and the nozzle 2 is provided vertically at a position displaced rearward in the rotational direction from the top of the cooling roll 1. As shown in FIG. 10, the shape of the tip of the nozzle 2 is formed so that a wall **2*a* at rear of the slit assumes a position higher than a wall 2*b* frontwardly of the slit. In this case, the angle of inclination $\theta$ of the nozzle 2 to the surface of the cooling roll 1** is set as not to exceed 40° for the reason similar to that of the first embodiment.

In the third embodiment apparatus, the tip of of the nozzle 2 is inclined to the surface of the cooling roll 1 similarly to the case of the second embodiment. 2 is formed to assume a position higher than the wall **2*b*** frontwardly of the slit, whereby the reservoir 4 formed between the tip of the nozzle 2 and the surface of the cooling roll 1 becomes larger than that of the prior art. Accordingly, as shown in FIG. 11, the surface roughness Rz can be decreased in the range wherein the angle of inclination $\theta$ does not exceed 40° similarly to the case of the first embodiment.

Furthermore, in the third embodiment apparatus, the nozzle 2 is arranged rearward in the rotational direction from the top of the cooling roll 1. Therefore, the contact length between the molten metal 3 drawn out of the reservoir 4 and the cooling roll 1 can be increased as compared with the prior art. Accordingly, there obtains an advantage in that the strip 5 having a large thickness as compared with the prior art can be easily manufactured.

The fourth embodiment of the present invention will be described hereinafter with reference to FIG. 12.

In the apparatus cf this embodiment, similarly to the prior art shown in FIG. 13, the molten metal 3 is blown out of the nozzle 2 arranged in close proximity of the top of the cooling roll 1 while rotating the cooling roll 1 made cf at a high speed whereby the molten metal 3 is drawn out in the form of a strip in the rotational direction of the cooling roll 1 while rapidly cooling and solidifying the molten metal 3 on the surface of the cooling roll 1. The cooling roll 1 in the present embodiment has its surface finished more roughly than a mirror surface polishing the surface using a polishing paper having the abrasive grain number of 600 to 1,000, preferably, 800, whereby the surface roughnesses of both surfaces of the strip 5 manufactured can be made approximately even.

The effectiveness of the present embodiment will be explained in accordance with the experimental result shown in FIG. 12.

Figure 12:
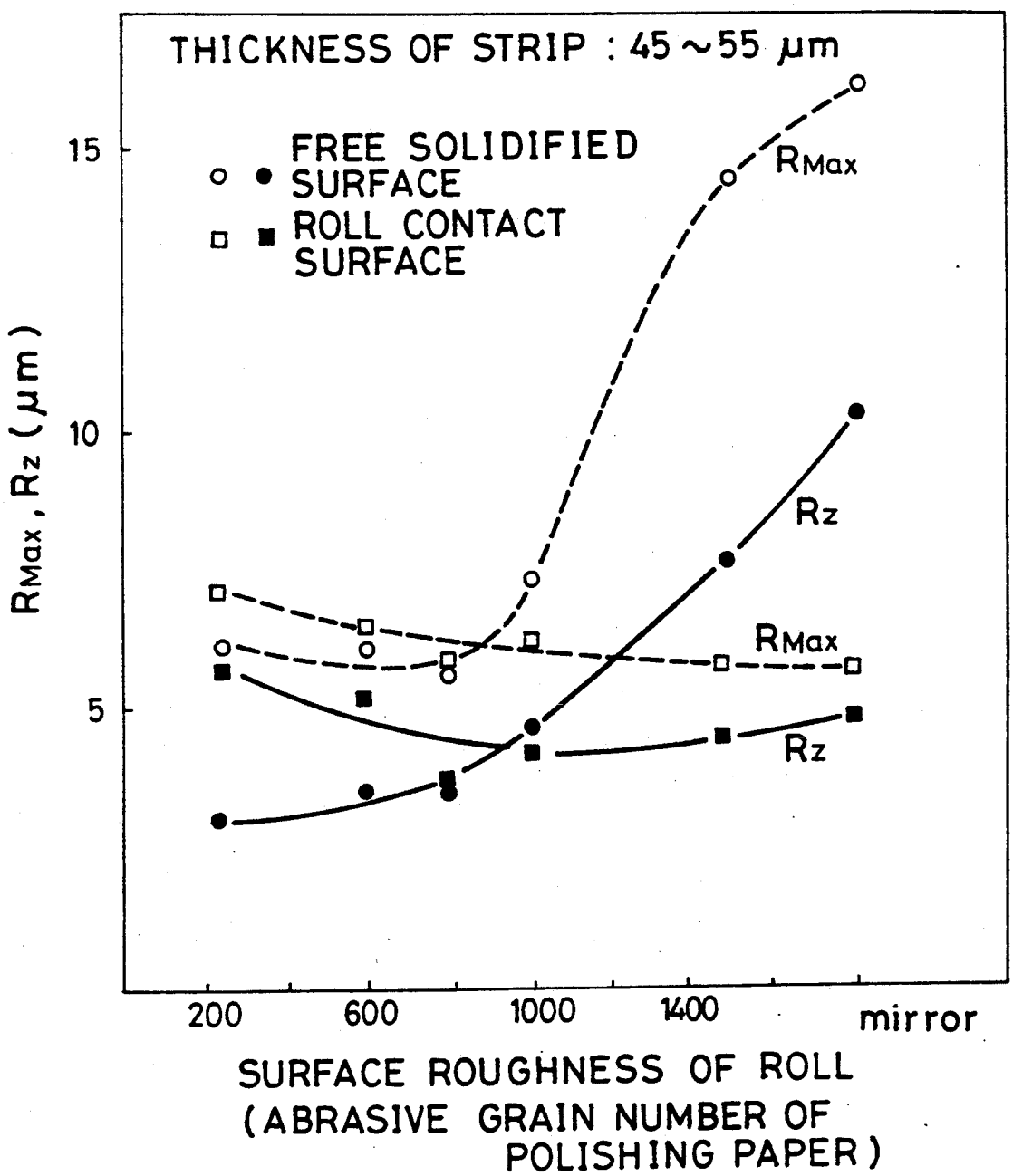
FIG. 12 is a view showing the relationship between the surface roughness of the cooling roll and the surface roughness of a strip produced according to a fourth embodiment.

FIG. 12 represents the relationship between the surface roughness of the cooling roll 1 and the surface roughness of the both surfaces of the strip 5. The axis of abscissa represents the abrasive grain number used for polishing the roll, and the axis of ordinate represents the cat whisker surface roughness meter, and the use of 10-point average roughness Rz as set forth in JIS B 0601.

It is understood from this figure that the larger the surface roughness of the roll (the smaller the abrasive grain number of the polishing paper) the surface roughness of the free solidified surface is better, and the smaller the surface roughness of the roll close to the mirror surface (the larger the abrasive grain number of the polishing paper), the surface roughness tends to be worsened. It is also understood that the surface roughness of the roll contact surface does not sc change according to the large or small of the abrasive grain number but the surface roughness tends to be improved as generally the roll surface roughness is smaller (the abrasive grain number is large).

In the case where the roll surface is polished by a polishing paper having the abrasive grain number of 800, both the surface roughnesses are approximately even, and the surface roughness in that case is approximately equal to the surface roughness of the roll contact surface in the case where the roll surface is a mirror surface (in case of prior art). Also in the case where a polishing paper having the abrasive grain number is 600 to 1,000, substantially similar result is obtained. When the abrasive grain number is outside the aforesaid range, the surface roughness in the free solidified surface becomes large and the irregularities in both surfaces become spread.

As described above, the roughness corresponding the roughness obtained by polishing the surface of the cooling roll 1 by use of a polishing paper having the abrasive grain number of 600 to 1,000, preferably. 800 is obtained whereby the surface roughnesses of the both surfaces of the strip 5 can be made sufficiently small and even. Accordingly, the apparatus of the present embodiment is suitably applied to the apparatus for making an amorphous alloy strip particularly as a blank for a voice magnetic head.

As described in detail above, the invention as set forth in claim 1 provides a manufacturing apparatus for manufacturing an amorphous metal strip by pouring molten steel from a nozzle to the surface of the cooling roll, and rapidly cooling and solidifying the molten metal on the cooling roll, in which the rotation of the cooling roll is gradually reduced in speed according to the passage of manufacturing time, whereby products having a fixed thickness can be obtained. Thus, there provides a practical effect capable of enhancing yield at low cost.

According to the invention as set forth in a second embodiment, the nozzle is arranged in close proximity of the top of the cooling roll in the state where the tip thereof is inclined to the vertical plane so as to be directed rearward in the rotational direction of the cooling roll. Therefore the reservoir formed between the tip of the nozzle and the surface of the cooling roll is large, and as a result, there provides an effect that the molten metal is stably drawn out of the reservoir and the strip whose surface is flat can be manufactured. Accordingly, this is suitably applied to the case of making the strip as a blank particularly for a voice magnetic head.

Furthermore, according to the invention as set forth in a third embodiment, the nozzle is arranged closely vertical to the position rearward in the rotational direction from the top of the cooling roll and the tip thereof is inclined to the surface of the cooling roll. Therefore, there provides an effect similar to that of the invention as set forth in a second embodiment and an effect that a long contact length between the molten metal and the cooling roll can be secured and therefore a strip having a great thickness can be easily manufactured.

Moreover, according to the invention as set forth in a fourth embodiment, the roughness is provided which corresponds to the roughness obtained by polishing the surface of the cooling roll by used of a polishing paper having the abrasive grain number of 600 to 1,000. Therefore, the strip is prevented from being slipping with respect to the roll. As a result, there provides an effect that the surface roughnesses of both surfaces of the strip to be manufactured can be made sufficiently small and even. Accordingly, this is suitably applied to the apparatus for making an amorphous alloy strip as a blank particularly for a voice magnetic head.

What is claimed is:

1. An apparatus for making an amorphous metal strip comprising:

a cooling roll having means for rotating the cooling roll in a direction about an axis and having a surface for receiving molten metal, said cooling roll further having means for rapidly cooling and solidifying molten metal on said surface;

a nozzle positioned adjacent to said cooling roll, said nozzle having an opening from which molten metal emanates under a fixed pressure, wherein said means for rotating said cooling roll has means for linearly reducing a rotational speed of said cooling roll from 1,000 rpm to 700 rpm after commencement of manufacture of a metal strip.

2. An apparatus for making an amorphous metal strip comprising:

a cooling roll which rotates in a direction about an axis and has a surface for receiving molten metal; and a nozzle having an opening facing said surface of said cooling roll for depositing molten metal on said surface while said cooling roll rotates to form a metal strip, wherein said surface of said cooling roll has a roughness corresponding to a roughness obtained by polishing said surface with a polishing paper having a range of abrasive grain numbers between 600 and 1,000.

* * * * *